United States Patent [19]

Kinugawa et al.

[11] Patent Number: 4,999,953

[45] Date of Patent: Mar. 19, 1991

[54] SUPERFINISHING MACHINE USING LAPPING FILM

[75] Inventors: Michio Kinugawa, Kumihama; Ryoji Inoue, Mineyama, both of Japan

[73] Assignee: Kabushiki Kaisha Nisshin Seisakusho, Kyoto, Japan

[21] Appl. No.: 381,743

[22] PCT Filed: Dec. 23, 1988

[86] PCT No.: PCT/JP88/01307

§ 371 Date: Jun. 22, 1989

§ 102(e) Date: Jun. 22, 1989

[87] PCT Pub. No.: WO89/06178

PCT Pub. Date: Jul. 13, 1989

[30] Foreign Application Priority Data

Dec. 26, 1987 [JP] Japan ..... 62-330698

[51] Int. Cl.[5] ..... B24B 21/02

[52] U.S. Cl. ..... 51/143; 51/141; 51/328

[58] Field of Search ..... 51/154, 155, 141, 143, 51/135 R, 328

[56] References Cited

U.S. PATENT DOCUMENTS 2,691,255 10/1954 Blazek ..... 51/143

2,715,302 8/1955 Jones ..... 51/143

FOREIGN PATENT DOCUMENTS 59-172110 9/1984 Japan .

61-173855 8/1986 Japan .

*Primary Examiner*—Robert A. Rose

*Attorney, Agent, or Firm*—Lockwood, Alex, FitzGibbon & Cummings

[57] ABSTRACT

A superfinishing machine using lapping film applied in superfinishing of the surface to be polished of the work which is rotated or turned reciprocally. The rotating direction of a pair of take-up reels for lapping film is changed over and controlled by the driving changeover means, and in cooperation with this changeover control, the follower friction wheels becoming the driven side are controlled by braking means. As a result, the whole grain surface of the lapping film can be used effectively. Besides, excessive withdrawal of the lapping film can be effectively prevented. There is also pressing means for pressing the lapping film against the surface to be polished of the work, so that high-precision polishing along the contour of the surface is realized.

6 Claims, 5 Drawing Sheets

SUPERFINISHING MACHINE USING LAPPING FILM

FIELD OF THE INVENTION

This invention relates to a superfinishing machine using lapping film, and more particularly to a superfinishing machine applied in superfinishing of the surface to be polished of the work which is rotated or turned reciprocally.

BACKGROUND OF THE INVENTION

As the surface finishing machine for finishing various roller surfaces by using lapping film abrasives, the device disclosed in the Jan. 1987 issue of the monthly publication "Machine Technology" is known.

In this machine, the lapping film which is taken up in the opposite direction of the roller rotating direction, that is, in a specific direction is pressed against the roller surface (the surface to be polished) by the contact roller reciprocatable in the roller axial direction, and the roller surface is uniformly finished.

However, in such composition as this conventional machine in which the lapping film taken up in one direction is pressed against the surface to be polished of the work (roller) rotating in the opposite direction to polish, if the surface to be polished of the work is a curved surface having an arc-shaped section with a small radius of curvature, such as the slipper surface of the rocker arm, the rate of the length of the portion of the lapping film passing through without being used in polishing of this curved surface with respect to the length of the portion of the lapping film used in polishing of the curved surface is extremely large, and the lapping film is spent wastefully.

On the other hand, when it is designed so that the work oscillates around the center of oscillation, the lapping film is advantageously stretched taut when the oscillating direction of the work is opposite to the moving direction of the lapping film, but when the both moving directions are same and the oscillation speed of the work is high, the lapping film is excessively drawn out from the feed spool side. Accordingly it may be sometimes impossible to polish while keeping the tension of the lapping film on the surface to be polished of the work.

Or, in the conventional structure of taking up the lapping film in one direction, when the lapping film once used in polishing is exchanged with a new lapping film on every occasion of use, the polishing work is interrupted by each exchange, and the working efficiency is significantly lowered.

Still more, in the structure of pressing the lapping film against the surface to be polished of the work by the contact roll, if there is a slight curvature in the widthwise direction in the work such as polishing of a curved surface of slipper surface of rocker arm as mentioned above, polishing along the surface to be polished curved in the widthwise direction becomes impossible.

DISCLOSURE OF THE INVENTION

This invention is intended to solve the abovediscussed problems, and presents a superfinishing machine using lapping film, in which a pair of take-up reels for lapping film are held within the same plane having follower friction wheels attached to the other ends of their rotary shafts, the follower friction wheels are pressed by either the follower gears disposed at both ends of a rotatable flat pi-shaped oscillation member or driving friction wheels mounted on the common shaft, the follower gears held on the oscillation member are engaged with a driving gear rotated by a driving motor, the pi-shaped contour part of the oscillation member contains a cylinder for changing over the drive for rotating the oscillation member about the pivot when the end of the lapping film being taken up is detected, an elastic pressing member linked with the pressing cylinder for pressing the lapping film being taken up in the direction of the surface to be polished of the work is disposed between the take-up reels, and the take-up reels are provided with brake cylinders for preventing the loosening of the lapping film on the follower friction wheels at the side being taken up.

Since it is designed so that the rotating direction of the pair of take-up reels for lapping film is changed over and driven by the cylinder for changing over the drive, the effective use of the whole grain surface of the lapping film may be realized.

Since the portion of the follower friction wheels of take-up reels is provided with brake cylinder for presenting a pressing force when the follower friction wheels comes to the follower side (driven side), if the oscillating work exerts an oscillating force in the same direction as the moving direction on the lapping film, excessive draw-out of lapping film is prevented, and the tension is maintained, so that polishing of oscillating work is realized. Accordingly, even if the work polishing surface is an arc section such as rocker arm, it is possible to polish with the surface to be polished always kept in contact with the polishing surface of the lapping film, so that the entire grain surface of the lapping film may be effectively utilized in the polishing work.

Moreover, since the lapping film is pressed against the surface to be polished of the work by the elastic pressing member, if the surface to be polished is slightly curved in the widthwise direction of the lapping film, polishing along the curved surface to be polished is possible.

PREFERRED EMBODIMENTS OF THE INVENTION

Figure 1:
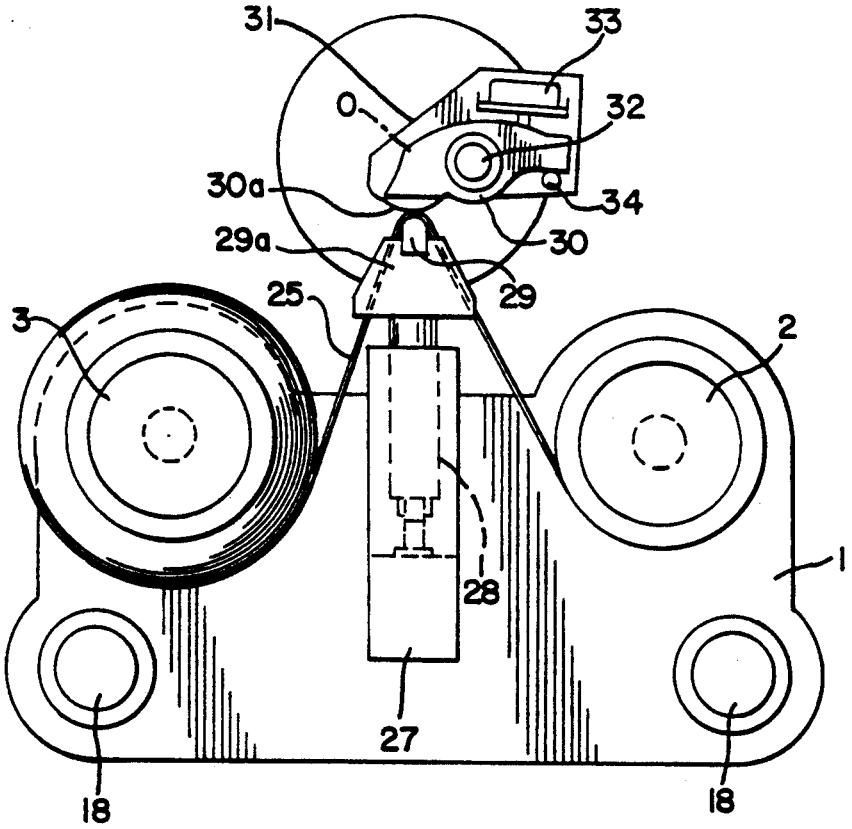
FIG. 1 is a plan view showing a superfinishing machine using lapping film in one of the embodiments of the invention.

FIG. 1 through FIG. 4 show a superfinishing machine using lapping film in one embodiment of the invention.

In the drawing, numeral 1 is a horizontal top plate disposed in the upper part of the superfinishing machine, and on this top plate 1, rotary shafts 4, 5 for holding two take-up rolls 2, 3 for lapping film within the same horizontal plane are rotatably supported by bearings 6, 7. At the lower ends of these rotary shafts 4, 5, follower friction wheels 8, 9 of the identical diameter having V-grooves disposed on the outer circumference are provided.

The top plate 1 is provided with a pivot 10 which projects downward, at a position equally distant from the rotary shafts 4, 5. At both ends of the flat pi-shaped oscillation member (FIG. 3) rotatably held at the lower end of the pivot 10, driving friction wheels 12, 13 of the shape to be engaged with the follower friction wheels 8, 9 are mounted coaxially with follower gears 16, 16 having the same number of teeth.

Numeral 19 is an intermediate plate held parallel to the top plate 1 by means of vertical shafts 18, 18, and on this intermediate plate 19, a driving motor 20 is mounted being disposed so that a driving shaft 21 may be directed upward and that its axial line may coincide with the axial line of the pivot 10. A driving gear 22 fitted to the upper end of the driving shaft 21 is engaged with the two follower gears 16, 17 simultaneously, thereby rotating the driving friction wheels 12, 13 coaxially mounted with the follower gears 16, 17 in the same direction and at the same rotating speed.

Which one of the take-up reels 2, 3 is driven is determined by changeover of the moving direction of a rod 24 by a twin rod cylinder 23 for changeover of drive disposed within the pi-shaped contour part of the oscillation member 11.

Figure 3:
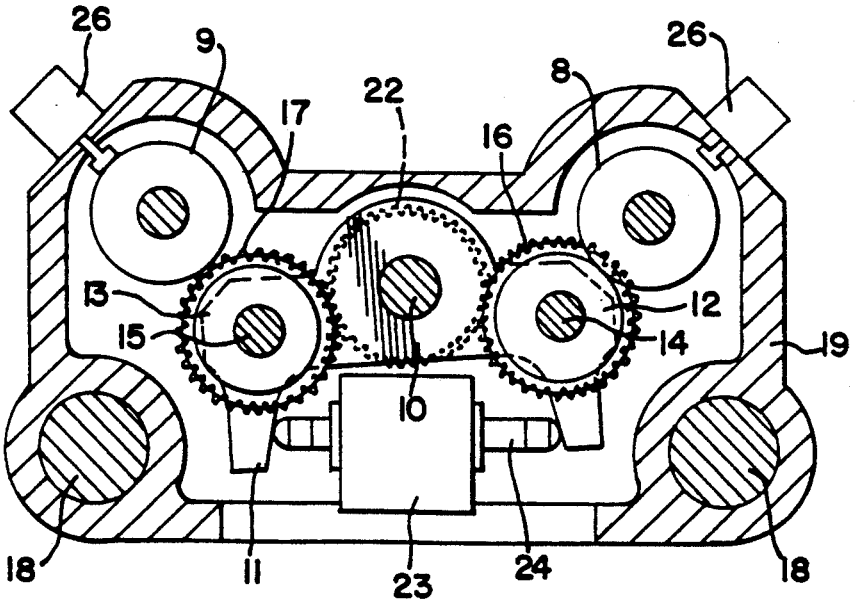
FIG. 3 is a sectional plan view of the same superfinishing machine along line III—III in FIG. 2.
Figure 2:
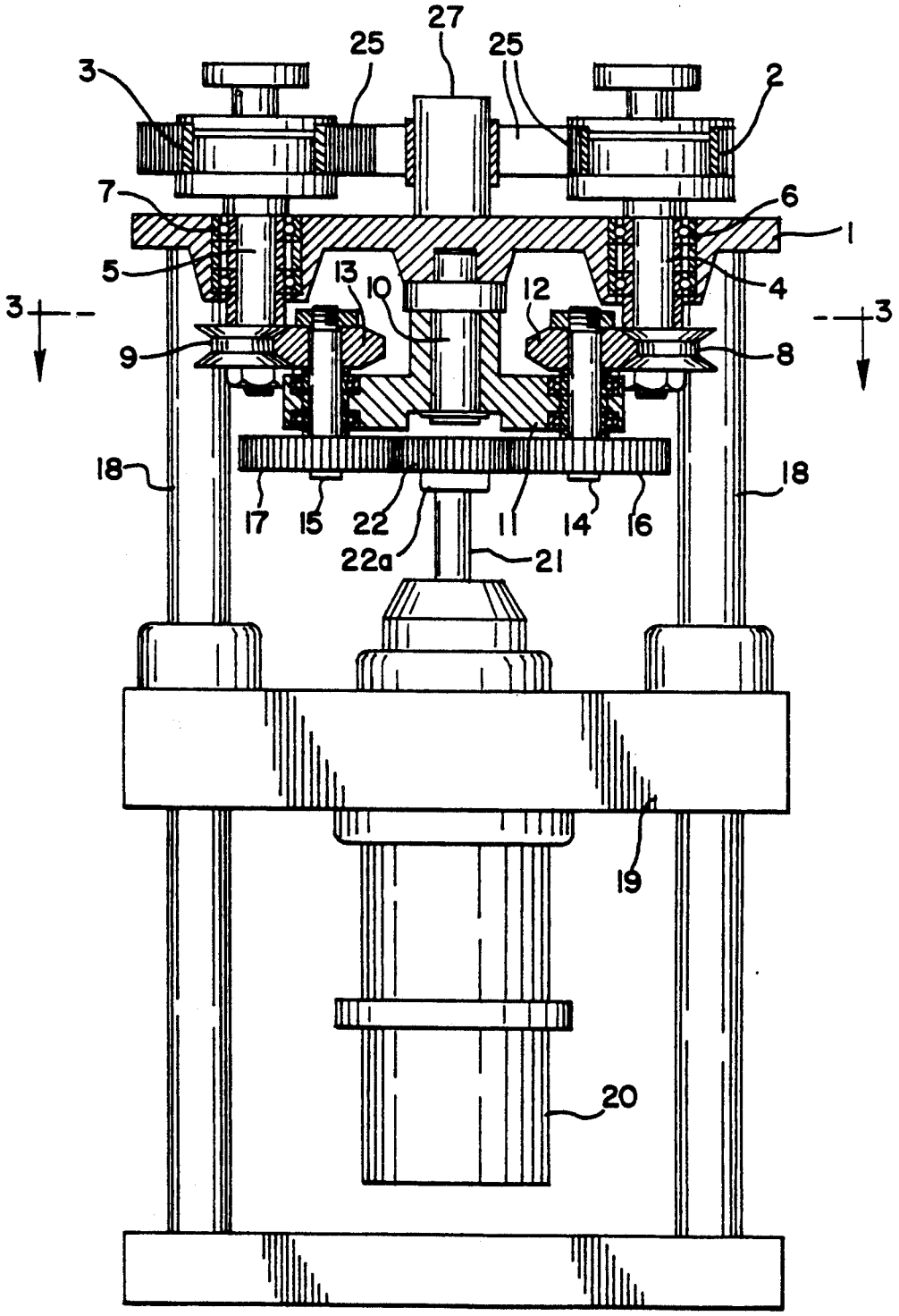
FIG. 2 is a rear view of the same superfinishing machine, showing part of FIG. 1 in a sectional view.

This changeover is effected by moving the rod 24 in either right or left direction in FIG. 3, by the working fluid in the cylinder 23 when the reflected light from the reflection tape glued to the final end of the lapping film 25 being taken up by, for example, a photoelectric tube (not shown). For instance, as shown in FIG. 3, when the rod 24 is moved to the right side, and the oscillation member 11 is rotated counterclockwise around the pivot 10, the driving friction wheel 12 is pressed by the follower friction wheel 8, and the take-up reel 2 is driven, and the take-up reel 2 takes up the lapping film 25 from the other take-up reel 3 not being driven.

The following friction wheels 8, 9 coaxial with the take-up reels 2, 3 are provided brake cylinders 26, 26 for pressing the periphery of the follower friction wheels 8, 9 with a preset force in order to apply a tension to the lapping film 25 to be taken up when they are not driven by the driving friction wheels 12, 13 and become the driven side. Numeral 27 is a pressing cylinder disposed between the take-up reels 2, 3, and the lapping film 25 is held to press against the surface to be polished of the work 30 by an elastic pressing member 29 made of, for example, hard urethane rubber attached to the end of the rod 28 of the pressing cylinder 27 through holding member 29*a*.

The polishing operation of the curved surface of rocker arm by the machine of this embodiment is described below.

The rocker arm (work) 30 having a curved surface (an arc-shaped section) 30*f*ed to a fixed shaft 32 projecting upward from the jig 31, and the tail end of the rocker arm 30 is pushed to the stopper 34 by the pressing member 33, thereby holding so that the relation to the jig 31 may be specific. This jig 31 is fitted to the oscillation shaft 37 in the vertical direction being oscillated by the servo motor 35 through reduction gear 36, and when the servo motor 35 is driven, the rocker arm 30 oscillates about the center of oscillation 0 together with the jig 31.

Operating the pressing cylinder 27, the elastic pressing member 29 attached to the end of the rod 28 is pushed out, and the lapping film 25 taken up on the driving side take-up reel 2 from the driven side take-up reel 3 is pressed against the curved surface 30*a* of the rocker arm 30 with a specified force.

In this state, when the driving motor 20 and servo motor 35 are driven, the follower friction wheel 8 at the side of the take-up reel 2 rotated by the driving gear 22 does not receive the pressing action of the brake cylinder 26, but the follower friction wheel 9 at the side of the driven side take-up reel 3 receives the pressing action of the brake cylinder 26, and the lapping film 25 is always kept in the taut state in any direction of the oscillation of the rocker arm 30 by the servo motor 35, thereby polishing the curved surface 30*a*.

Accordingly, the curved surface 30*a* of the rocker arm 30 oscillated as being held horizontally can be polished to a specified surface finishing degree efficiently in a short time.

The rocker arm 30 is oscillated for a set number of surface 30*a* is stopped at a position not contacting with the elastic pressing member 29. At this stopping position, the pressing action by the pressing member 33 is released, and the rocker arm 30 is drawn out of the fixed shaft 32, and a new rocker arm 30 is mounted on the fixed shaft 32, and the tail end of the rocker arm 30 is pressed against the stopper 34 by the pressing member 33, and the driving motor 20 and servo motor 35 are dine again, and the same polishing operation is repeated.

When the lapping film 25 nears its end by the repeated lapping operations, the reflected light from the reflection tape (not shown) glued to the final end of the lapping film 25 is detected by a photoelectric tube (not shown). As a result, by the output from the photoelectric tube, the rod 24 of the cylinder 23 is changed over from the pressing in the right direction shown in FIG. 3 to the pressing in the left direction, and the oscillation member 11 is rotated clockwise about the pivot 10. In consequence, the driving friction wheel 12 having hitherto pressing and driving the follower friction wheel 8 is deprived of the driving action, and the other driving friction wheel 13 presses and drivers the other follower friction wheel 9, so that the driving side and follower side (driven side) are changed over between the take-up reels 2 and 3.

The output from the photoelectric tube changes over the pressing direction of each rod of the two brake cylinders 26, 26 at the same time, and when take-up of the lapping film 25 in one direction is over, the lapping film 25 is automatically rewound in the opposite direction, and the lapping film 25 still having the polishing ability is repetitively used effectively, so that the curved surface 30*a* of the rocker arm 30 may be polished to a desired degree of surface finishing.

In the foregoing embodiment, the curved surface 30*a* is polished while moving the lapping film 25 continuously, but it is equally possible to stop after feeding the lapping film 25 by a specified amount, and oscillate the rocker arm 30 to polish its curved surface 30*a*.

Or if the degree of surface finishing in the returning stroke of the reciprocal motion of the lapping film 25 is questionable, the number of oscillations of the rocker arm 30 may be set slightly higher in the returning stroke than in the going stroke.

Figure 5:
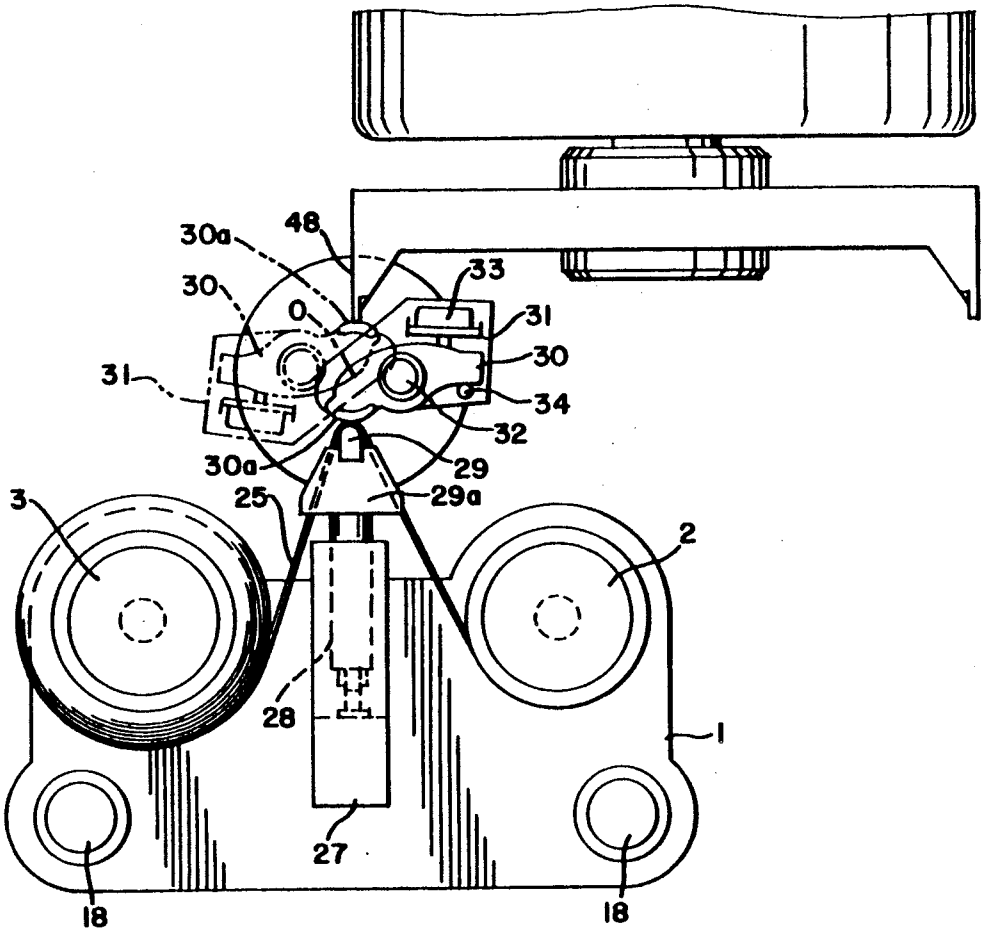
FIG. 5 is a plan view showing a superfinishing machine using lapping film in other embodiment of this invention.
Figure 4:
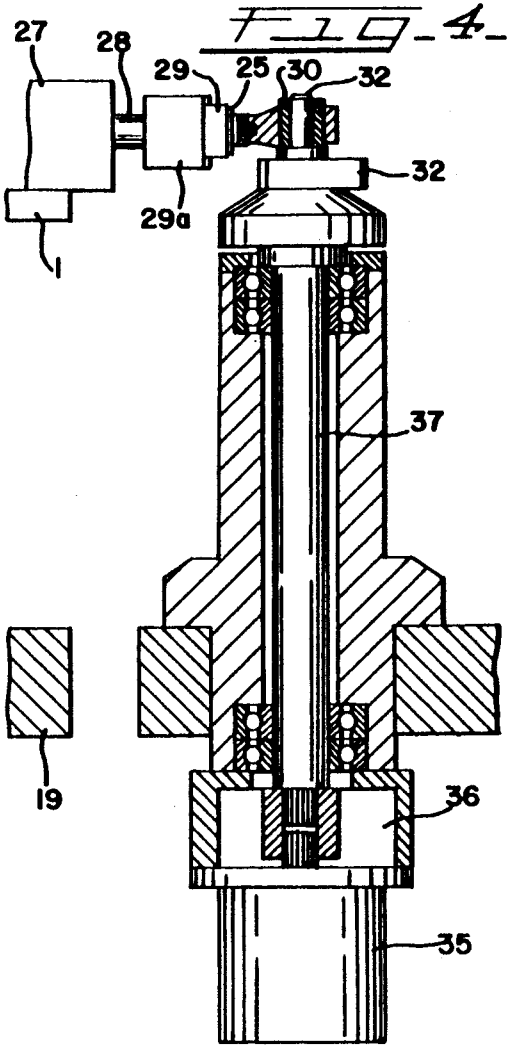
FIG. 4 is a side view of essential parts of the same superfinishing machine showing part of FIG. 1 in a sectional view.
Figure 6:
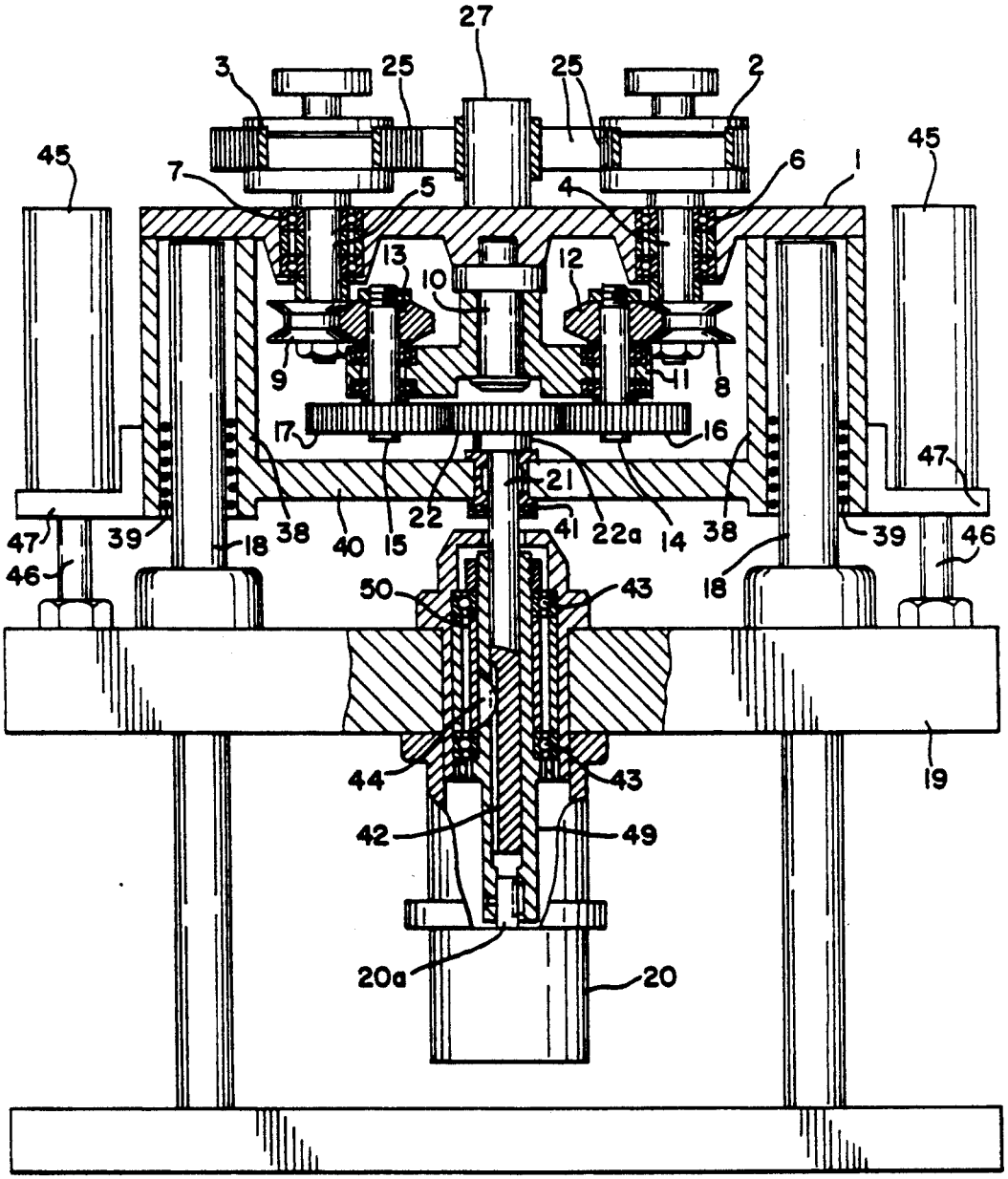
FIG. 6 is a rear view of the same superfinishing machine showing part of FIG. 5 in a sectional view.
Figure 7:
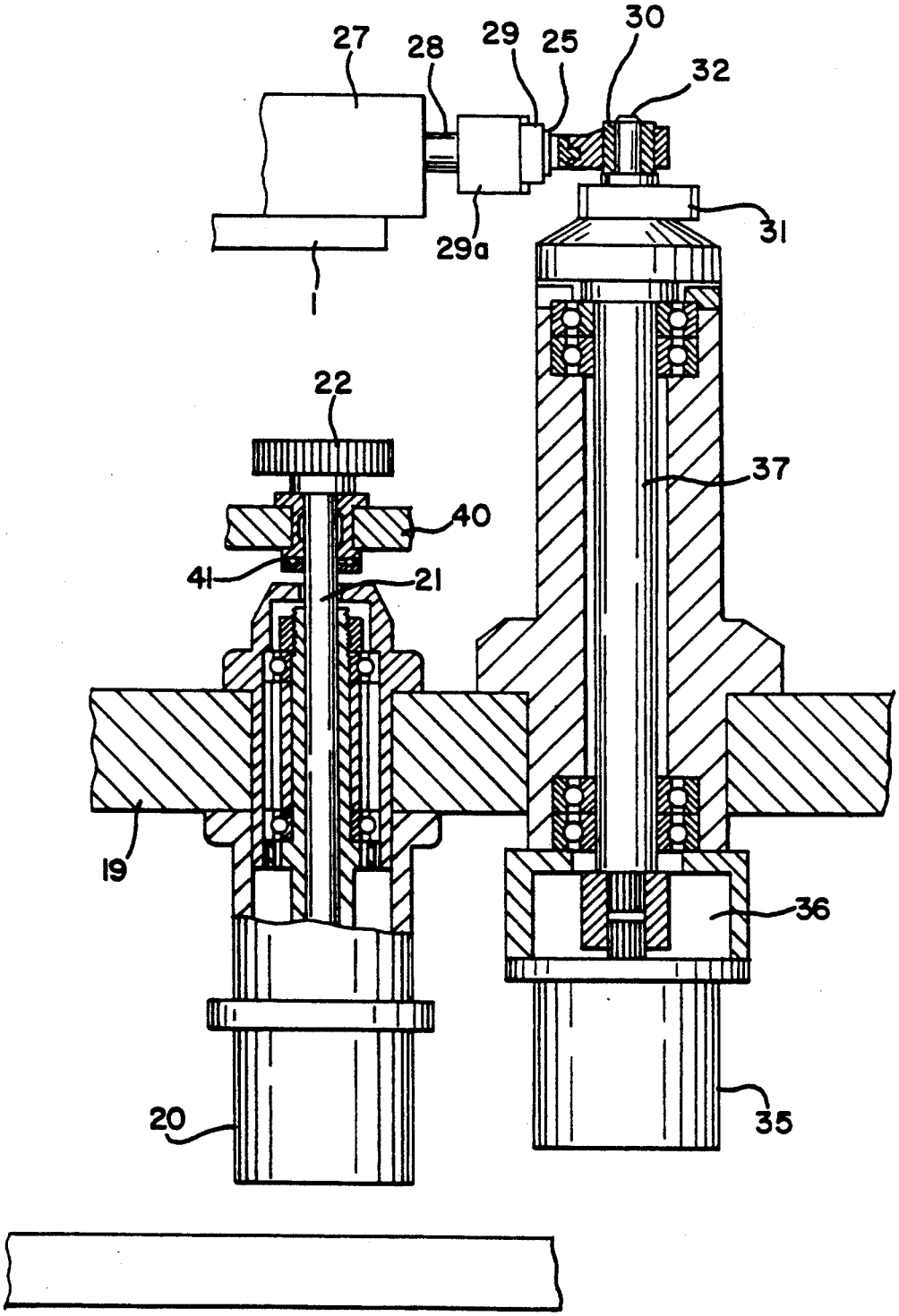
FIG. 7 is a side view of essential part of the same superfinishing machine showing part of FIG. 5 is a sectional view.

FIG. 5 to FIG. 7 relate to other embodiment of the invention. Tubular members 38, 38 disposed downward from the top plate 1 in the foregoing embodiment are respectively held by slide balls 39, 39 provided between vertical shafts 18, 18, so as to be slidable in the vertical direction along each vertical shaft 18.

The tubular members 38, 38 are linked together by a horizontal linkage member 40, and the driving shaft 21 of the driving motor 20 is stopped on the linkage member 40, and its upper end is rotatably held by a bearing 41 which abuts against the lower surface of the boss part 22*a* of the driving gear 22.

Inside the driving motor 20, the majority of the driving shaft 21 is inserted into the tubular member 49 integrally coupled with the motor shaft 20*a* by means of key and screw so as to be slidable in the vertical direction.

The tubular member 49 is rotatably held by bearings 43, 43, and a woodruff key 44 abutting against the inside of a hollow tube 50 mounted between bearings 43, 43 and held in the tubular member 49 is engaged with a key guide groove 42 formed in the lengthwise direction of the driving shaft 21, so that the movement in the lengthwise direction of the driving shaft 21 may be effected smoothly.

Numeral 45 is a vertical motion cylinder having a rod 46 set downward in the vertical direction, and the vertical motion cylinders 45, 45 are outside of the tubular members 38, 38 by means of L-members 47, 47, and the lower ends of their rods 46 are fixed on an intermediate plate 19. Accordingly, when a downward fluid pressure acts on the rods 46, 46, instead of the rods 46 that cannot be moved downward, the vertical motion cylinders 45, 45 are moved upward. Along with this movement, by the tubular members 38, 38 on which the vertical motion cylinders 45, 45 are mounted, the top plate 1 is moved upward and, at the same time, the driving shaft 21 on which the driving gear 22 is mounted is moved upward by the bearing 41 of the linkage member 40 which couples the tubular members 38, 38 together. Therefore, even when the top plate 1 moves in the vertical direction, the engagement between the driving gear 22 and follower gears 16, 17 is kept in normal state.

In the machine of this embodiment, the servo motor 35 with reduction gear 36 in the foregoing embodiment is held together on the intermediate plate 19, and the rocker arm 30 fitted on the fixed shaft 32 is oscillated about the center of oscillation 0 together with the jig 31. Numeral 48 is a grinding wheel having a U-section polishing surface, and this grinding wheel 48 is designed to be moved toward the rocker arm 30, and it has a curved surface 30*a* about the center of oscillation 0 with respect to that rocker arm 30 which is oscillated.

The operation of this embodiment is explained below.

In the state as shown in FIG. 5, by the rotation of the grinding wheel 48 and the oscillation of the rocker arm 30 indicated by double dot chain line being held by the jig 31, a downward force is applied to each rod 46 of the vertical motion cylinders 45, 45 while the curved surface 30*a* of specified radius is formed in the rocker arm 30 in order to move so that the lowest surfaces of the holding member 29*a* and elastic pressing member 29 attached to the front end of the rod 28 of the pressing cylinder 27 may be set slightly higher than the highest surfaces of rocker arm 30 of the jig 31 and pressing member 33.

When forming of the curved surface 30*a* by the grinding wheel 48 is over, the rocker arm 30 is once stopped at a position oscillated in the outward direction (counterclockwise in FIG. 5) so as not to contact between the curved surface 30*a* and the grinding wheel 48, and then the curved surface 30*a* is rotated to the position opposite to the elastic pressing member 29 by means of the servo motor 35. Simultaneously with stopping of this rotation, the direction of the fluid pressure acting on each rod 46 of the vertical cylinders 45, 45 is changed over, and the top plate 1 is lowered to the original height.

In this state, the pressing cylinder 27 is operated, and the lapping film 25 is pressed against the curved surface 30*a* with a preset force by the elastic pressing member 29 at the end of the rod 28.

In succession, by the driving of the driving motor 20, the lapping film 25 is moved in one direction, while the rocker arm 30 is oscillated in a specified angle range around the center of oscillation 0 by the servo motor 35, and by sharing the oscillation means of the device for forming the curved surface 30*a* of approximately arc section in the rocker arm 30, the curved surface 30*a* immediately after being formed by the grinding wheel 48 can be superfinished by the lapping film 25.

The other effects obtained by the machine of this embodiment are same as in the embodiment shown in FIG. 1 to FIG. 4.

In the machine of this embodiment, meanwhile, when the grinding wheel 48 is composed so as to be moved forward and backward with respect to the rocker arm 30 together with its rotation driving means and rotate the jig 31 clockwise around the center of oscillation 0 after moving back the grinding wheel 48, the vertical motion means of the top plate 1 may be omitted.

As clear from the description herein, the constitution of this invention brings about the following outstanding effects:

(1) Since the rotating direction of a pair of take-up reels for lapping film is designed to be changed over and controlled by the driving changeover cylinder, the whole grain surface of the lapping film can be effectively utilized, and the portion of the lapping film passing through without being used in polishing of the surface is completely eliminated. Still more, one lapping film can be used repeatedly by reciprocating, and the life of the lapping film itself is extremely long as compared with that of the conventional film, and the cost may be saved remarkably.

(2) Since the pressing force by brake cylinder can be applied to the follower friction wheel of the take-up reel at the follower side, superfinishing can be processed efficiently by the lapping film moved while keeping a taut state with respect to the surface to be polished of the work which is oscillated.

(3) Since the surface of the work being oscillated can be superfinished, the waste of the grain surface of the lapping film being fed without use not contacting with the surface is eliminated, and, in this respect too, the whole grain surface of the lapping film can be utilized effectively.

(4) When the winding end or terminal end of the lapping film is detected, the oscillating member is rotated about the pivot, and the driving side of the take-up reel is changed over, so that the lapping film still having a sufficient polishing capacity depending on the finishing condition can be repeatedly used in polishing when rewinding.

(5) Since the lapping film is pressed against the surface to be polished of the work by the elastic pressing member, if the surface to be polished is slightly curved in the widthwise direction, the entire surface can be polished.

What is claimed is:

1. A superfinishing machine using lapping film having a grain surface on the work surface to be polished which is reciprocated, comprising:

a pair of take-up reels for lapping film rotatably held through respective rotary shafts;

follower friction wheels attached to one end of said respective rotary shafts;

an oscillation member oscillatably held by way of a pivot;

driving friction wheels rotatably disposed at both ends of the oscillation member, said driving friction wheels being frictionally engageable with the follower friction wheels;

driving means for rotating and driving the driving friction wheels;

driving changeover means for detecting the terminal end of lapping film taken upon the take-up reels, and oscillating the oscillation member between two positions;

braking means for braking the follower friction wheels becoming the driven side, in cooperation with the driving changeover means; and pressing means for pressing the lapping film against the surface to be polished of the work.

2. A superfinishing machine using lapping film according to claim 1, further including:

means for holding the work and for oscillating and rotating the work; and wherein the driving means, driving changeover means and pressing means are composed so as to be movable in the vertical direction with respect to the holding means.

3. A superfinishing machine using lapping film, in which a pair of take-up reels of lapping film are held within a same plane, and follower friction wheels are disposed at the other end of their rotary shafts;

the follower friction wheels are pressed by engaging means disposed at both ends of a flat rotatable pi-shaped oscillation member;

the engaging means held on the oscillation member are engaged with a driving gear which is rotated by a driving motor;

a driving changeover cylinder for rotating the oscillation member about a pivot when the final end of the lapping film being taken up is detected is disposed in the pi-shaped contour part of the oscillation member;

elastic pressing means linked to a pressing cylinder for pressing the lapping film being taken up against the surface of a work to be polished is installed between the take-up reels; and the take-up reels are provided with a brake cylinder for preventing loosening of the lapping film on the follower friction wheels at the side to be taken up.

4. A superfinishing machine using lapping film according to claim 3, wherein said engaging means are driving friction wheels which pressingly engage said follower friction wheels.

5. A superfinishing machine using lapping film according to claim 3, wherein said engaging means includes follower gears mounted coaxially with respect driving friction wheels.

6. A superfinishing machine suing lapping film according to claim 3, further including means for holding the work and for oscillating and rotating the work.

* * * * *

UNITED STATES PATENT AND TRADEMARK OFFICE

CERTIFICATE OF CORRECTION

PATENT NO. : 4,999,953

DATED : March 19, 1991

INVENTOR(S) : Kinugawa et al.

It is certified that error appears in the above-identified patent and that said Letters Patent is hereby corrected as shown below:

Col. 1, line 62, "abovedis" should read --above dis- --.

Col. 2, line 8, insert --final--before "end".

Col. 3, line 63, "30fed" should read --30a is fitted--.

Col. 4, line 25, after "of" insert --times, and when the driving motor 20 stops, the curved--.

Col. 5, line 29, insert --installed-- before "outside".

Col. 6, line 10, insert --motion-- before "cylinders".

Col. 8, line 5, "of" should read --for--; line 8, "end" should read --ends--; line 34, "suing" should read --using--.

Signed and Sealed this

Fifteenth Day of June, 1993

*Attest:*

Michael K. Kirk

MICHAEL K. KIRK

*Attesting Officer*

*Acting Commissioner of Patents and Trademarks*